US007057590B2

(12) United States Patent
Lim et al.

(10) Patent No.: US 7,057,590 B2
(45) Date of Patent: Jun. 6, 2006

(54) LED ARRAY IMPLEMENTATION

(75) Inventors: Swee Hock Alvin Lim, Singapore (SG); Jasmeet Singh Narang, Singapore (SG)

(73) Assignee: Infineon Technologies AG, Munich (DE)

( * ) Notice: Subject to any disclaimer, the term of this patent is extended or adjusted under 35 U.S.C. 154(b) by 85 days.

(21) Appl. No.: 10/702,188

(22) Filed: Nov. 4, 2003

(65) Prior Publication Data

US 2005/0093006 A1 May 5, 2005

(51) Int. Cl.
*G09G 3/32* (2006.01)

(52) U.S. Cl. ..... 345/84; 345/82

(58) Field of Classification Search ..... 345/76–84; 315/169.3
See application file for complete search history.

(56) References Cited

U.S. PATENT DOCUMENTS 5,798,535 A * 8/1998 Huang et al. ..... 257/83

FOREIGN PATENT DOCUMENTS

EP 00597226 A1 * 5/1994

* cited by examiner

*Primary Examiner*—Regina Liang
*Assistant Examiner*—Duc Q. Dinh
(74) *Attorney, Agent, or Firm*—Fish & Richardson P.C.

(57) ABSTRACT

An LED array arrangement that reduces the number of control inputs needed to operate it is described. The reduction in the number of control pins is achieved through the use of logical 'AND' decoding and multiplexing of the control input signals.

7 Claims, 6 Drawing Sheets

Row Decoding for output lines 1-4

LED matrix as implemented in INCA-IP

Row Decoding for output lines 1-4

Timing Diagram of signals on LED output lines

Decoding technique using all the column control input

Timing Diagram with full-decoding

LED ARRAY IMPLEMENTATION

FIELD OF THE INVENTION

The present invention relates generally to LED arrays. In particular, the invention relates to improved implementation of LED arrays.

BACKGROUND OF THE INVENTION

LEDs (light emitting devices) are used in a wide variety of electronic devices as a display for example, to convey information about the status of a device or as a monitor. The various types of LEDs include organic LEDs, semiconductor LEDs and liquid crystal displays. FIG. 1 shows a conventional arrangement 100 for a plurality of LEDs. The LEDs are arranged as a matrix with the plurality of LEDs connected in rows 11 and columns 13. An LED 101 of the matrix comprises a first terminal 102 and a second terminal 103 (e.g. an anode and a cathode). The first terminal 102 of each LED 101 in a column 13 are connected together and coupled to a column control input 150 while the second terminal 103 of each LED in a row 11 are connected together and coupled to a row control input 180. In order to enable a specific LED, the row and column corresponding to that LED are activated through the respective row and column control input. As illustrated in FIG. 1, each column of LEDs 13 is connected to a column select transistor 110. The column select transistors 110 selectively couple or decouple the columns to a reference voltage 130 (e.g. Vcc which represents a logic 1) depending on the states (active or inactive) of the column control inputs 150 coupled to transistor gates 105. For the arrangement in FIG. 1, providing a logic 0 (active signal) at a column control input 150 switches on the pnp column select transistor 110 and the first terminals 102 of the LEDs in that column are coupled to Vcc 130 (logic 1). Similarly, a row 11 is also activated by providing a logic 0 (active signal) at the row control input 180. The voltage established across the LED with its row 11 and column 13 activated switches it on. The number of voltage levels in an active signal used to light up an LED depends on the type of display. For example, a monochromatic display only requires a one bit digital signal as the LED is either on or off. In a grayscale or color display, a multilevel digital or an analog signal is used to achieve a range of a specific color between full on and full off.

The conventional arrangement as described above requires a separate control input for each column and row in the matrix. Therefore the number of LEDs that can be driven is limited by the formula m*n, where m=number of column control inputs, n=number of row control inputs and the total number of control input lines required=m+n. This arrangement can prove to be inefficient when the LED matrix has a large number of rows and columns. For example, in order to implement a matrix comprising of 400 LEDs, 40 control inputs or external connections are required. Correspondingly, if a chip is used to control the LED matrix, it will be required to have 40 control pins just to address the matrix. As evident from above, the conventional arrangement is not conducive to miniaturization of chip size and presents a problem particularly in portable electronic devices such as mobile phones, radios and chipcards.

Some attempts to increase the number of LEDs controlled by a given number of pins have led to the use of external decoders and decoding switches (as taught in European Patent Nos. EP597226-A1 and EP809228-A2 which are herein incorporated by reference in their entirety into the present disclosure). Generally, in these implementations, a plurality of decoding switches are used wherein each decoding switch is coupled to a row/column control pin and a group of individual rows/columns. An external decoder is connected to the plurality of decoding switches for selecting an addressed row/column within a group. This approach, however, has the disadvantage of increasing the overall Bill of Materials (BOM) as there is a need for an external decoder and decoding switches for each group of rows/columns.

It would be desirable to provide an arrangement that would increase the number of LEDs that can be controlled by a given number of inputs while not increasing the BOM significantly.

SUMMARY OF THE INVENTION

The invention relates generally to the implementation of LED arrays. In particular, the invention relates to an improved implementation for an LED array wherein the number of inputs required to control the array is reduced.

The number LEDs implemented in the array is increased by using a combination of logical 'AND' decoding for the rows and/or columns as well as time division multiplexing (TDM) to multiplex the state for each row/column control input. This allows at least one of the row/column inputs to control more than one row/column.

In one embodiment, each column of LEDs in the array is coupled to a column select switch. The columns of LEDs in the array are also organized into a number of subsets which are mutually exclusive each subset of columns being coupled to a column decoding switch which selectively couples a column reference voltage through the column select switches to the columns of LEDs when both the column decoding switches and column select switches are activated. The columns of LEDs are sequentially coupled to the column reference voltage by activating the column decoding switches sequentially and for each activated column decoding switch the corresponding plurality of column select switches are activated sequentially.

PREFERRED EMBODIMENTS OF THE INVENTION

Figure 1:
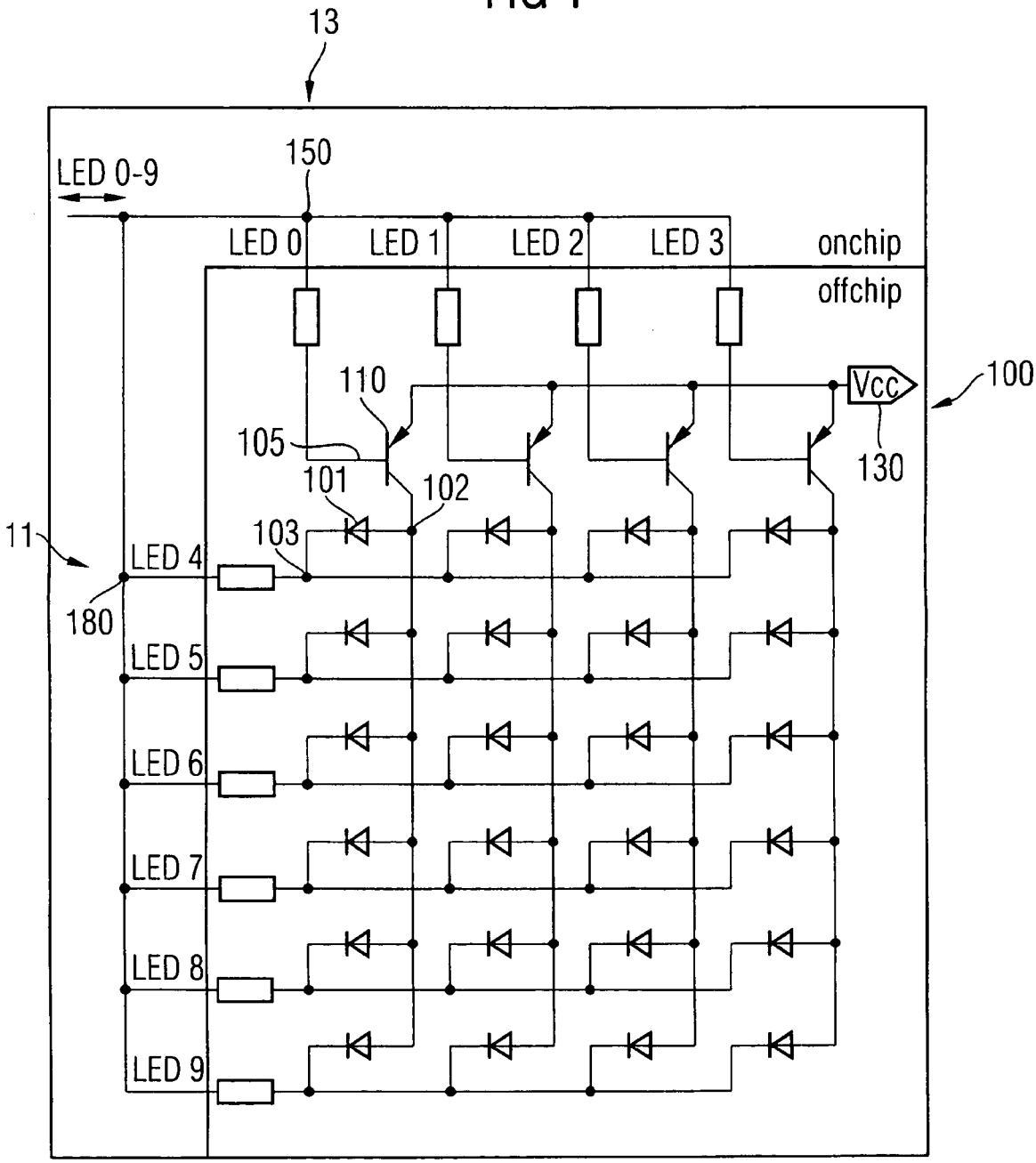
FIG. 1 shows a conventional arrangement for an LED array.

The present invention increases the number LEDs implemented in the array by using a combination of logical 'AND' decoding for the rows and/or columns as well as time division multiplexing (TDM) to multiplex the state for each row/column control input. In the conventional implementation of the LED matrix, each column control input or row control input is only able to control one column or row respectively. In the present invention, at least one of the row/column control inputs is coupled to more than one row/column. Logical 'AND' decoding during time division activation of the control inputs is then used to distinguish which one of the plurality of rows/columns attached to an activated control input is being selected.

Multiplexing

In a time division multiplex system, each channel is assigned a fixed time slot and sampled in a regular sequence by a multiplexer. When the all channels have been sampled, the sequence starts over with the first channel. Thus samples from a particular channel are interleaved in time between samples from other channels. A method of LED implementation using time multiplexing technique is taught in Patent No. DE 27 45817A1 by W. Hoehn which is herein incorporated by reference in its entirety into the present disclosure. However, unlike the present invention, Hoehn doesn't disclose decoding of the control input lines. In a conventional arrangement of an LED array, each row/column control input is coupled to one row/column. Taking the columns to be analogous to channels, sampling of the columns is implemented by activating the column control input sequentially at a given frequency. During the sampling of a particular column, only the rows having LEDs to be lit are activated. Alternatively, the rows may serve as channels that are activated sequentially and during the sampling of a particular row, only the columns having LEDs to be lit are activated. Since each channel is not monitored continuously in a time division multiplex system, the frequency of sampling is preferably high enough so that the human persistence of vision causes the appearance of the activated LEDs to always appear lit (for example at a repetition rate of 117 Hz).

In accordance with the present invention the column or row control inputs are also activated sequentially in a time division multiplex manner. At least one of the row or column control inputs is coupled to more than a single row or column. 'AND' decoding is applied to distinguish which column or row attached to an activated control input is enabled. Logical 'AND' decoding can be applied to either the rows or columns or both together. This allows the number of rows and columns addressed by a given number of control inputs to be increased.

In one embodiment, 'AND' decoding for columns is implemented by using one of the column control inputs as a configcol (configure column) input line and providing a first and second 'AND' column decoding switch coupled to it that operate in a 'push-pull' manner. For example, when the configcol input signal is at logic 0, the first column decoding switch will be closed while a logical 1 will close the second column decoding switch. Each column control input is coupled to a column pair comprising of first and second column. The set of first columns is coupled to the first 'AND' column decoding switch while the second set of columns is coupled to the second 'AND' column decoding switch. The 'AND' logical decoding for columns is then implemented as follows: A column pair comprising a first and second column of LEDs is selected when the column control input associated with it is activated. Based on the logical level (0 or 1) of the configcol input signal one of the columns in the selected column pair is enabled.

Figure 2:
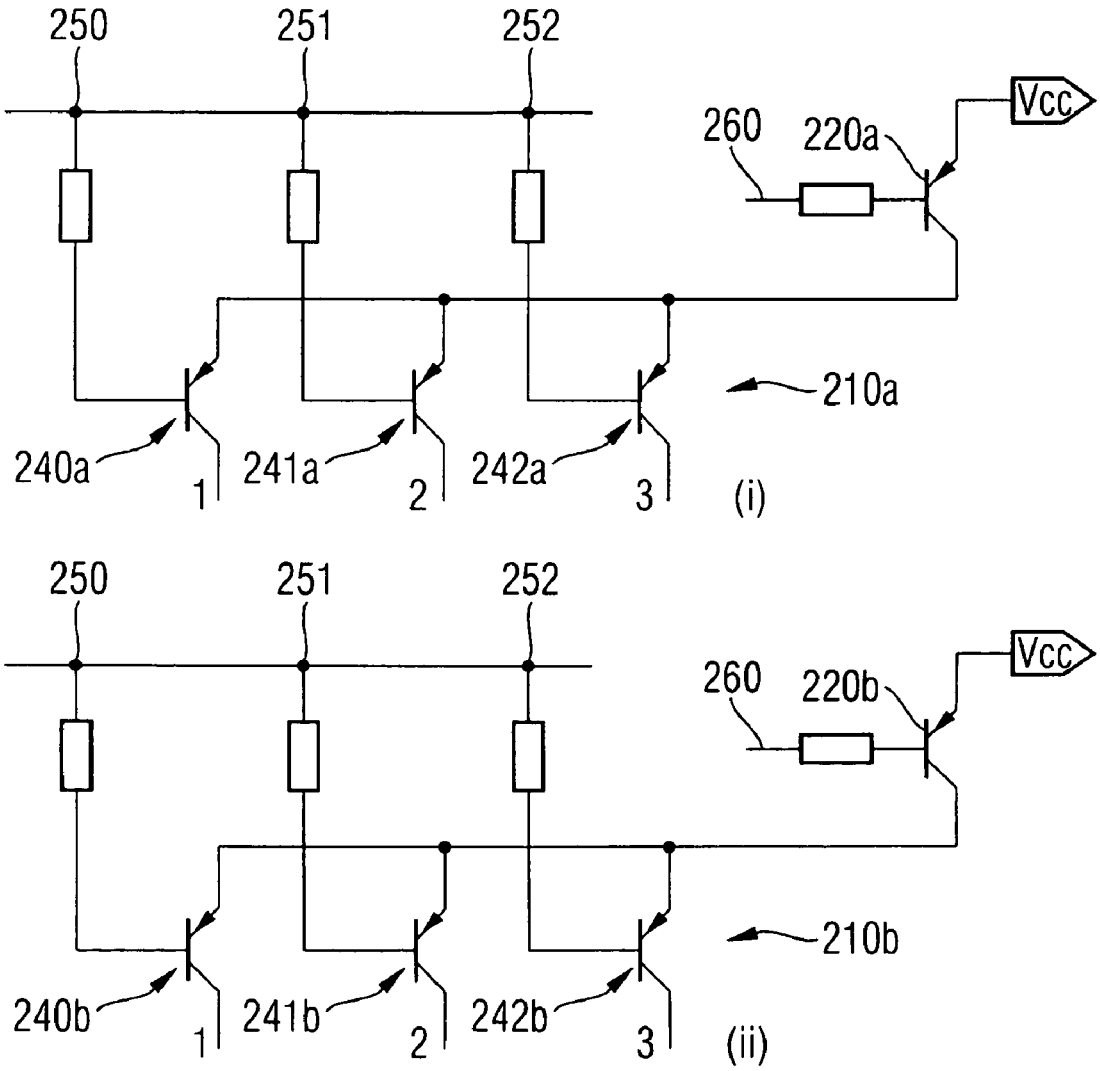
FIG. 2 shows an LED array in accordance with one embodiment of the invention.

FIG. 2 shows an LED array implementation using column decoding in accordance with one embodiment of the invention. Illustratively there are three column control inputs (250, 251, 252) and one configcol input 260. In actual implementation, the number of column control inputs is not restricted to three and the LED array arrangement in FIG. 2 could include a different combination of rows and columns and/or LEDs oriented in a different directions. Each column control input is coupled to a pair of complementary columns of LEDs having first and second columns 240*a* and 240*b*. Activation of columns is controlled by the column control input signal and configcol signal using logical 'AND' decoding.

In one embodiment, a column is activated when it is coupled to Vcc (e.g. logic 1). Each column is selectively coupled or decoupled from Vcc via a column select transistor 210*a,b* and a column decoding transistor (220*a,b*). The pair of column decoding transistors function as a 'push-pull' column decoding switch. In order to couple a column to Vcc (thereby activating it) both the column select and column decoding transistors have to be switched on (conductive). In one embodiment, the gates of the column select transistors in a column pair are coupled to a common column control input (250, 251, 252). When the column control input is inactive (logic 1), the column select transistors are switched off (non-conductive). Activating the column control input (logic 0) enables the column select transistors coupled to it. Depending on the state of the configcol signal input to the configcol input 260, one of the columns in the column pair associated with the enabled column control input is activated. In one embodiment, a pnp transistor 220*a* is used as the column decoding transistor for the first set of columns (240*a*, 241*a*, 242*a*) while an npn transistor 220*b* is used as the column decoding transistor for the second set of columns (240*b*, 241*b*, 242*b*). It is preferable to use complementary transistors as column decoding switches, as only one input is required to selectively activate one of the switches. Assuming that an active signal (logic 0) is provided at the column control input 250, a configcol signal input to the configcol input 260 at logic 0 activates column 240*a* while logic 1 activates 240*b*. Besides bipolar transistors, other types of transistors such as FETs are also suitable.

Figure 3:
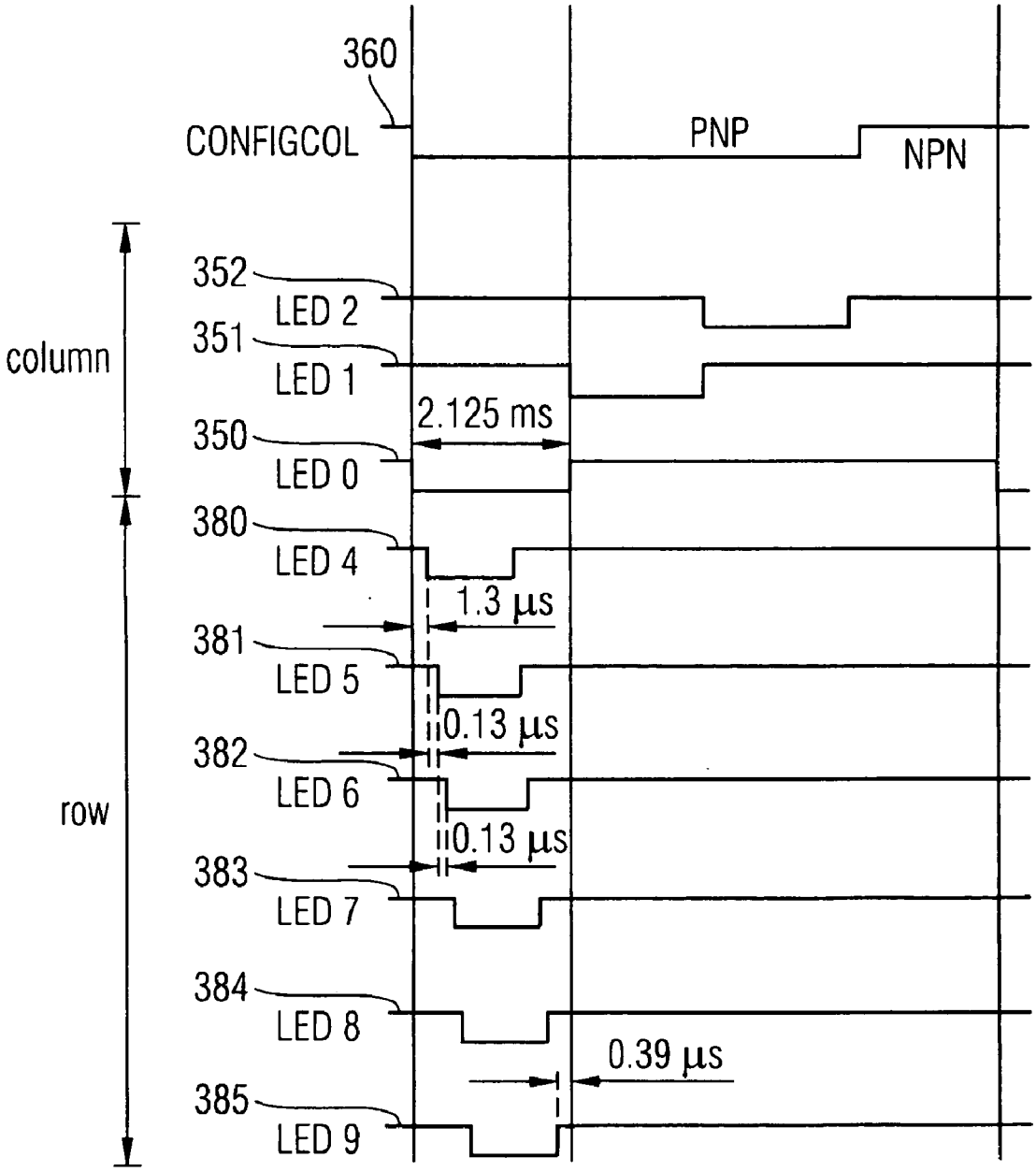
FIG. 3 shows the timing of row and column input signals and config signals which control the LED array in accordance with one embodiment of the invention.

FIG. 3 shows a timing diagram of the input signals to the LED matrix in accordance with one embodiment of the invention. The timing diagram comprises column control input signals 350–352 (which correspond to the signals 250–252 in FIG. 2) and row control input signals 380–385 (which correspond to the signals input to the row inputs of FIG. 1) Unlike the prior art configuration of FIG. 1, the present inventive embodiment of FIG. 2 allows for the four column control input signals to control six columns rather than only four. The columns are used as sampling channel. The columns are sampled by a series of scan cycles in each of which the column control inputs are activated sequentially (e.g. by pulsing the column control input to logic 0). Since the columns are decoded using 'AND' logic, an additional configcol input signal 360 with logic states 0 and 1 is provided. When the configcol signal is at 0, a first set of columns gets activated sequentially and when configcol signal is at 1, a second set of columns gets activated sequentially. When a particular column is sampled, the rows having LEDs to be lit are activated (e.g. by pulsing the row control input low sequentially). In one preferred embodiment, the rows are turned on and off with a delay to reduce the power consumption while switching. This is because a current spike may result from switching on all the LEDs at the same time. In one embodiment, the settings for which LEDs need to be lighted up may be programmed in a register. A state machine then translates this information into a combination of applied voltages for activating the LEDs.

The LED multiplex unit within the state machine includes a timing control to multiplex the information for each channel (either row or column).

Figure 4I:
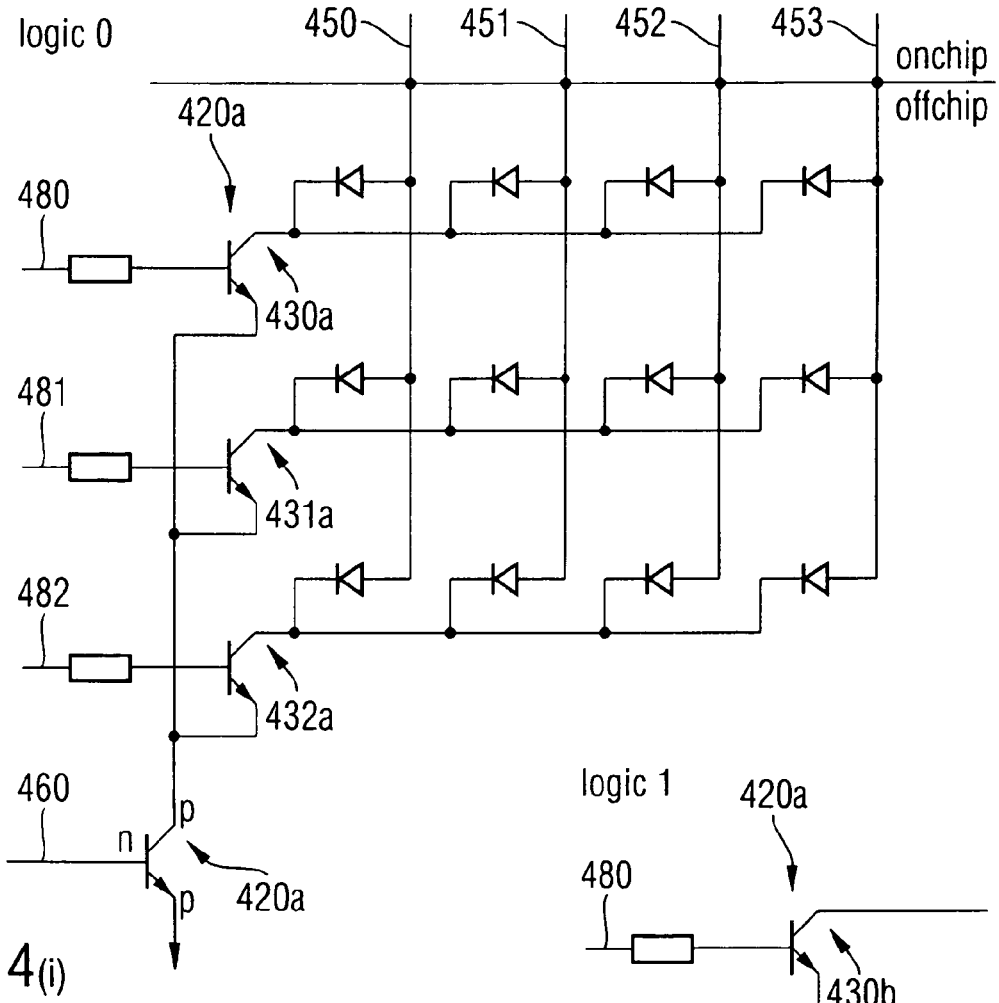
FIGS. 4(i) and 4(ii) an LED array with row decoding in accordance with one embodiment of the invention.
Figure 4:
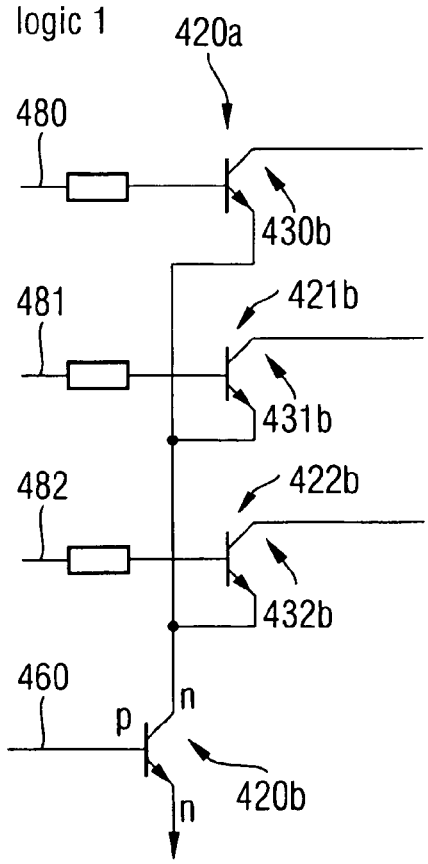

Alternatively, in another embodiment, as shown in FIG. 4, 'AND' decoding for rows can be implemented instead by providing a configrow (configure row) input line 460 and first and second 'AND' row decoding switches 420*a*, 420*b* which operate in a 'push-pull' manner. Applying logical 'AND' decoding to the rows, activating a row involves providing an active signal at both the row control input 'AND' configrow input in order to switch on both the row select and row decoding transistors coupled to it. In the embodiment shown in FIG. 4, an activated row is coupled to a pull-down circuit e.g. ground. In one embodiment, the row control inputs coupled to the gates of the row select transistors 420*a*, 420*b* are activated sequentially (by driving it low) in a time division multiplex manner. The logical level of the configrow input signal to the config row input line 460 would then determine which row of LEDs associated with the activated row control input is activated. In one embodiment, a pnp transistor 420*a* is used as the row decoding transistor for the first set of rows (430*a*, 431*a*, 432*a*) while an npn transistor 420*b* is used as the row decoding transistor for the second set of rows (430*b*, 431*b*, 432*b*). When a particular row is sampled, the columns having LEDs to be lit are activated (e.g. by pulsing the column control input high sequentially).

In another embodiment, both row and column 'AND' decoding can be implemented by providing a configcol input and a pair of 'push-pull' column decoding switches as well as a configrow input and a pair of 'push-pull' row decoding switches. Either the rows or columns can be used as a sampling channel.

Using the logical 'AND' decoding as described in the present invention, the LED matrix that can be controlled by the same number of input lines or output pins is extended.

In the conventional implementation of the LED matrix, each column control input or row control input is only able to control one column or row respectively. Therefore, if the total number of input lines X=10 and the number of input lines assigned to the columns Y=4, the total number of LEDs implemented in the array is only=(X−Y)*Y=(10−4)*4=24.

For the embodiments described above, if the number of input lines assigned to columns=4, the number of LEDs that can be controlled is given by the following formulas:

$$\text{Column decoding (only)}=(X-Y)(Y-1)*2=6*3*2=36$$

$$\text{Row decoding (only)}=(X-Y-1)*(Y)*2=5*4*2=40$$

$$\text{Column and row decoding}=\{(X-Y-1)*(Y-1)*2\}*2=\{5*3*2\}*2=60$$

The −1 in the above equations accounts for one input line (configrow, configcol) that has to be provided for logical 'AND' decoding of the rows and columns. As evident from the above calculations, the number of LEDs that can be controlled is increased by at least 1.5× (if column decoding is used) and even more if both row and column decoding are used. Whether the increase is more by row or column decoding depends on the implementation of the rows and columns.

As seen from FIGS. 2 and 4, the configcol input 260 and configrow input 460 switch between two states to control two sets of columns/rows with each input. However, in other embodiments, the configcol and configrow inputs can switch between three or more states to control three or more setd of columns/rows with each input. This can be implemented using devices each having active/inactive voltage different from each other.

Figure 5:
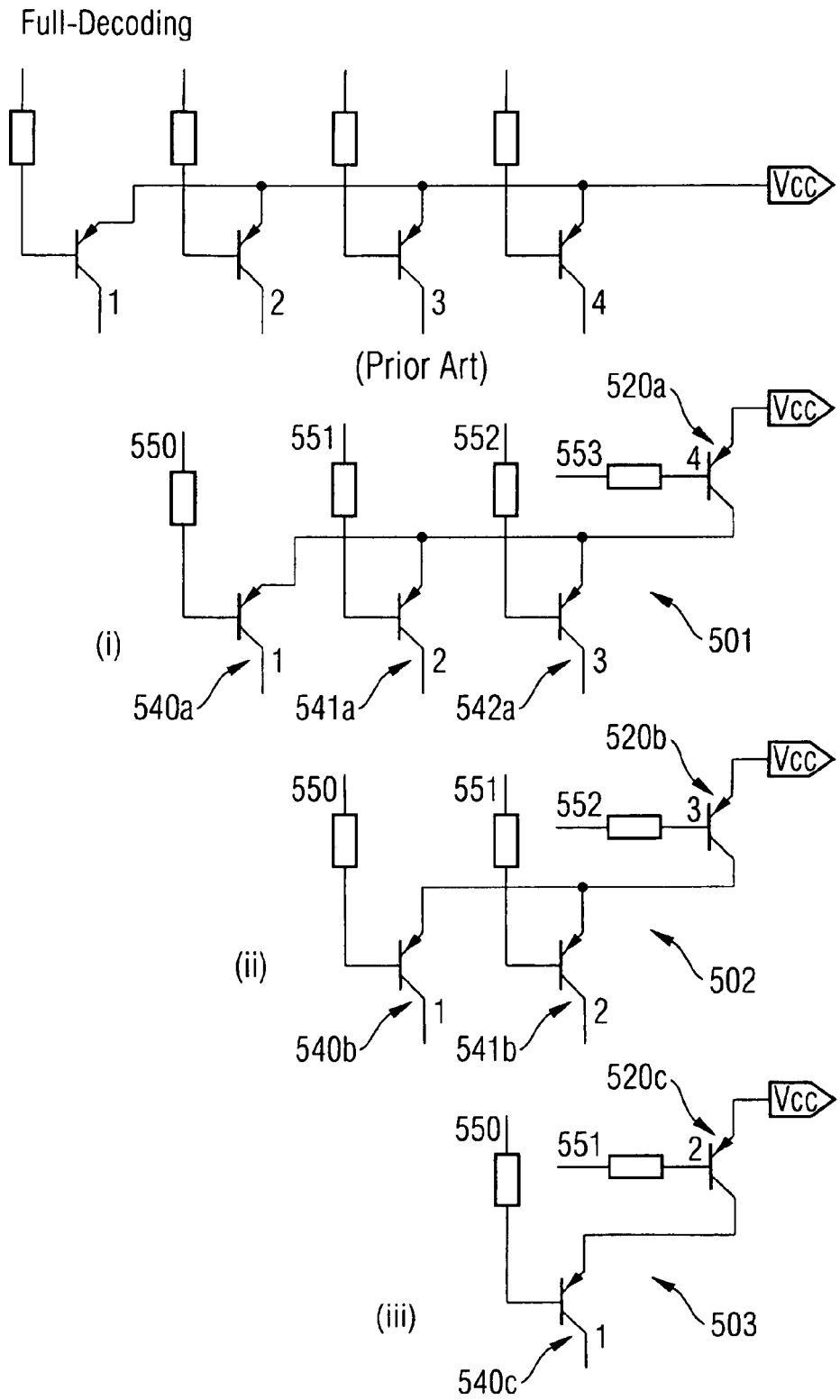
FIG. 5 shows the decoding technique using all the column control input lines of the present invention as compared to the prior art matrix implementation.

In another embodiment of the invention, all the column control input lines are used to implement 'AND' column decoding during TDM activation of the column control inputs. Activating a unique pair of the plurality of column control input lines provided activates a column in the LED array. This is based on the concept that ${}^{N}C_2$ unique pairs may be arranged from N objects. Therefore, if the number of column control input lines N=4, ${}^{4}C_2=6$ unique columns can be configured using the principle of this embodiment. FIG. 5 illustrates an arrangement for implementing this embodiment of the invention. In FIG. 5(*i*), unique pairs 550–553, 551–553 and 552–553 are formed, input 553 being coupled to column decoding transistor 520*a*, and inputs 550, FIG. 5(ii), unique pairs 550–552 and 551–552 are formed, input 552 being coupled to column decoding transistor 520*b* and inputs 550 and 551 being coupled to column select transistors 540*b* and 541*b* respectively. In FIG. 5(iii), unique pair 550–551 is formed, input 551 being coupled to column decoding transistor 520*c* and input 550 being coupled to column select transistor 540*c*. Column control inputs 550, 551, 552 can be activated by driving them low. Alternatively, the column control inputs may also be activated by driving them at high. A column in the LED array is coupled to a column select transistor (540, 541, 542) and a column decoding transistor 520, the transistors are switched on or off (conductive or non-conductive) based on the state (active or inactive) of the column control input coupled to the gate. By activating both column control inputs, the column select and column decoding transistors are switched on and the column is coupled to Vcc, thereby activating it.

Figure 6:
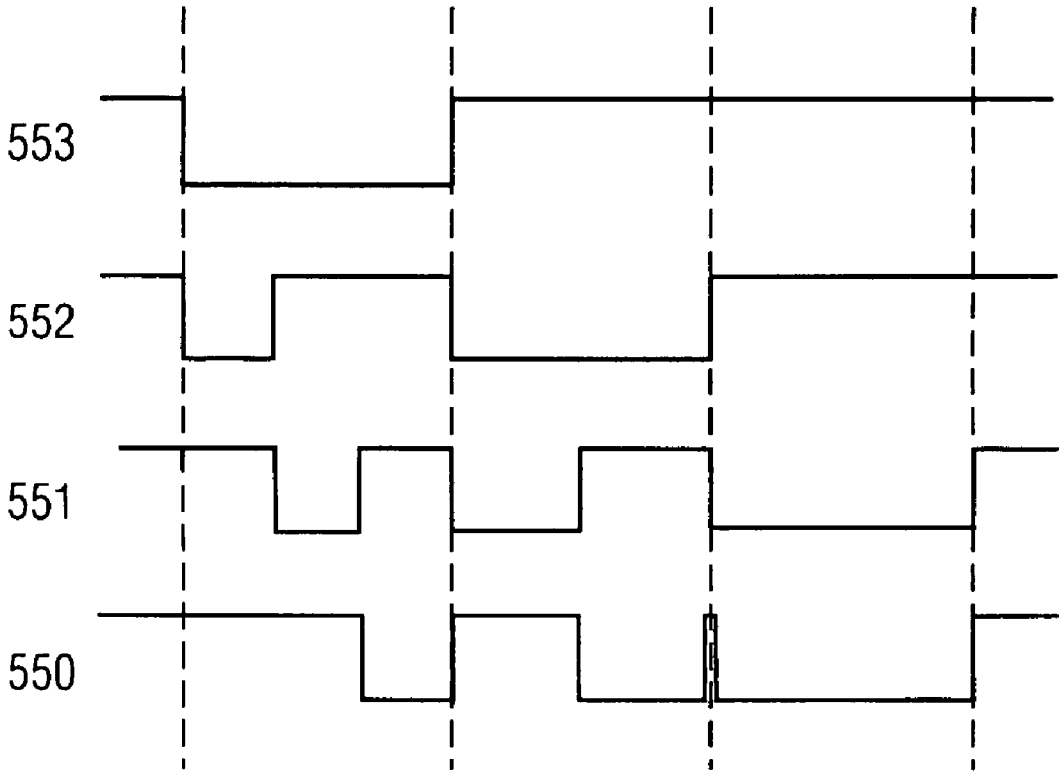
FIG. 6 shows the timing of column input signals which control the LED array embodied in FIG. 5

FIG. 6 illustrates the timing diagram of the input signals for the LED arrangement of FIG. 5. The columns in the LED array are organized into a number of subsets that are mutually exclusive. Each subset is coupled to a column decoding transistor (520*a*, 520*b*, 520*c*) that is switched on or off by the state of the column control input coupled to it. The column decoding transistors, for example, are n-BJTs. Other types of transistors such as p-BJTs or FETs may also be used. For the embodiment illustrated, there are three subsets of columns 501, 502 and 503. Using the columns as a sampling channel, a subset is first selected for sampling by switching on the column decoding transistor 520 coupled to it. The columns within the subset are then sampled by activating the column control inputs sequentially (by pulsing the column control input to logic 0). When a particular column is sampled, the rows having LEDs to be lit are activated (e.g. by pulsing the row control input low sequentially). For example, subset 501 is first selected by activating column control input 553. The columns (540*a*, 541*a*, 542*a*) in the subset are then sampled by activating the column control inputs 550, 551 and 552 sequentially (by driving it low). When a column is sampled, the rows attached to it (not shown) that have LEDs to be lit are activated. Preferably the rows are turned off and on with a delay to reduce power consumption while switching.

The invention has been particularly shown and explained in conjunction with various useful or alternative embodiments. It will be recognized by those skilled in the art that modifications and changes may be made to the present invention without departing from the spirit and the scope thereof. The scope of the invention should therefore be determined not with reference of the above description of the embodiment, but with reference to the appended claims along with their full scope, including any equivalents.

What is claimed is:

1. An LED array comprising:

a plurality of LEDs, each with a first and second terminal, wherein the plurality of LEDs are arranged in a plurality of columns of LEDs having their first s terminals electrically connected and a plurality of rows of LEDs having their second terminals electrically connected;

a plurality of column select switches, each column select switch being coupled to a column of the LEDs;

a plurality of column control input terminals for receiving column control input signals, a column control input terminal being coupled to n of the column select switches, wherein n is at least two, for selectively activating the column select switches when an active column control input signal is provided;

a plurality of column decoding switches, each column decoding switch attached to a plurality of column select switches for selectively coupling a column reference voltage through the column select switches to the columns of LEDs when both the column decoding switches and column select switches are activated;

a configcol input terminal for receiving configcol input signals coupled to n column decoding switches of the plurality of decoding switches, the configcol input signals having n states causing the nth column decoding switch to be activated when the configcol input signal is in the nth state;

the column decoding switches activated sequentially and for each activated column decoding switch the corresponding plurality of column select switches activated sequentially to provide the column reference voltage sequentially to the columns of LEDs; and the LEDs in the array lit by providing a row reference voltage to the rows having LEDs to be lit when a column is coupled to the column reference voltage.

2. The LED array of claim 1 wherein:

a column control input terminal is coupled to two of the column select switches; and the configcol input terminal is coupled to first and second column decoding switches of the plurality of column decoding switches, the configcol input signals having a first or second state causing the first column decoding switch to be activated when the configcol input signal is in the first state and the second column decoding switch to be activated when the configcol input signal is in the second state.

3. The LED array of claim 2 wherein:

each of the column select switches comprises a transistor;

the first column decoding switch comprises a pnp transistor; and the second column decoding switch comprises an npn transistor.

4. The LED array of claim 1 further comprising:

a plurality of row select switches, each row select switch being coupled to a row of LEDs;

a plurality of row decoding switches, each row decoding switch attached to a plurality of row select switches for selectively coupling the row reference voltage through the row select switches to the rows of LEDs when both the row decoding switches and row select switches are activated; and the row decoding switches activated sequentially and for each activated row decoding switch the corresponding plurality of row select switches activated sequentially to provide the row reference voltage sequentially to the rows having LEDs to be lit.

5. The LED array of claim 4 further comprising:

a plurality of row control input terminals for receiving row control input signals, a row control input terminal being coupled to m of the row select switches, where m is at least two, for selectively activating the row select switches when an active row control input signal is provided; and a configrow input terminal for receiving configrow input signals coupled to m row decoding switches of the plurality of row decoding switches, the configrow input signals having m states causing the mth row decoding switch to be activated when the configrow input signal is in the mth state and the second row decoding switch to be activated when the configrow input signal is in the second state.

6. The LED array of claim 1 further comprising:

a plurality of column control input terminals arranged in unique pairs, one of the column control input terminals in a unique pair coupled to a column select switch and the other column control input terminal coupled to a column decoding switch; and an active signal provided at a unique pair of the plurality of column control input terminals coupling one of the columns in the LED array to the column reference voltage by activating the column select switch and column decoding switch associated with the column.

7. The LED array of claim 5 wherein a row control input terminal is coupled to two of the row select switches; and the configrow input terminal is coupled to first and second row decoding switches of the plurality of row decoding switches, the configrow input signals having a first or second state causing the first row decoding switch to be activated when the configrow input signal is in the first state and the second row decoding switch to be activated when the configrow input signal is in the second state.

* * * * *